US010561554B2

(12) United States Patent
Horng et al.

(10) Patent No.: US 10,561,554 B2
(45) **Date of Patent: *Feb. 18, 2020**

(54) HEAD RELAXING PILLOW

(71) Applicants: Sy-Wen Horng, Taipei (TW); Chi-Wei Hung, Taipei (TW)

(72) Inventors: Sy-Wen Horng, Taipei (TW); Chi-Wei Hung, Taipei (TW)

( * ) Notice: Subject to any disclaimer, the term of this patent is extended or adjusted under 35 U.S.C. 154(b) by 338 days.

This patent is subject to a terminal disclaimer.

(21) Appl. No.: 14/193,043

(22) Filed: Feb. 28, 2014

(65) Prior Publication Data

US 2015/0245967 A1 Sep. 3, 2015

(51) Int. Cl.
*A61G 7/07* (2006.01)
*A47G 9/10* (2006.01)

(52) U.S. Cl.
CPC ..... *A61G 7/072* (2013.01); *A47G 9/1081* (2013.01)

(58) Field of Classification Search
CPC .. A61G 7/072; A61G 7/07; A61G 7/065–072; A61G 7/1082; A61G 7/1084; A61G 15/105–125; A61G 13/121; A61G 5/1043; A61G 5/1045; A61G 5/4048; A47G 9/1081; A47G 9/1072; A47G 9/10–109; A47G 2009/1018; A41G 2009/1018; A61F 5/56; A61F 2005/563; A47C 7/36–383; A47C 1/036; A47C 1/037; A47C 1/10; A47C 7/18; B60N 2/882; B60N 2/80–897; B60N 2002/899
See application file for complete search history.

(56) References Cited

U.S. PATENT DOCUMENTS 4,550,458 A * 11/1985 Fiore ..... A47C 7/383 297/393
5,360,017 A * 11/1994 Austin ..... A47G 9/10 5/640
7,437,788 B1 * 10/2008 Holman ..... A47G 9/10 5/636

(Continued)

OTHER PUBLICATIONS 12.2 Interaural time delays: non-continuous sounds, Jun. 18, 2018, OpenLearn, http://www.open.edu/openlearn/science-maths-technology/science/biology/hearing/content-section-12.2.*

(Continued)

*Primary Examiner* — Keri J Nelson
*Assistant Examiner* — Michelle J Lee
(74) *Attorney, Agent, or Firm* — Rosenberg, Klein & Lee

(57) ABSTRACT

The present invention is to provide a head relaxing pillow, which is made of an elastic material and includes a supporting main body having a top for supporting the neck of a user who lies face up and a bottom concavely provided with a recess, two contact portions each having one end connected to one of the two corresponding ends of the supporting main body and the other end corresponding in configuration to one of the user's parietal bones, and a pressing portion extending from one side of the supporting main body and located between the contact portions. The supporting main body is provided with two sunken portions which are adjacent to two corresponding ends thereof respectively. Thus, when the user's neck and head are resting on the supporting main body and the contact portions respectively, the two sunken portions are corresponding in position to the user's temporal bones respectively.

5 Claims, 8 Drawing Sheets

(56) References Cited

U.S. PATENT DOCUMENTS

| | | | | |
|---|---|---|---|---|
| 7,669,265 | B2 * | 3/2010 | Weise | A47C 7/383<br>297/393 |
| 8,739,336 | B2 * | 6/2014 | Kiefer | A47C 20/00<br>5/636 |
| 8,813,283 | B2 * | 8/2014 | Alexander | A47G 9/1081<br>5/636 |
| 2009/0293885 | A1 * | 12/2009 | Lee | A61H 7/001<br>128/845 |
| 2010/0286729 | A1 * | 11/2010 | Haugen | A61F 5/01<br>606/240 |

OTHER PUBLICATIONS

John E. Upledger, D.O., F.A.A.O. And Jon D. Vredevoogd, M.F.A., Craniosacral Therapy, Eastland Press,1983, p. 39-45; p. 57-59; p. 77-80; p. 161-163; p. 203-211.

* cited by examiner

HEAD RELAXING PILLOW

FIELD OF THE INVENTION

The present invention is to provide a head pillow, in particular to a head relaxing pillow made of an elastic material for supporting the neck and the head of a user who lies face up and is in a configuration for allowing the gaps in the user's skull to open slightly to lower the pressure of the cerebrospinal fluid in the skull, and thereby to enhance circulation of the cerebrospinal fluid.

BACKGROUND OF THE INVENTION

Recently, with the vigorous development of information dissemination and the rapid changes in modern society, the pace of lives has been increasing, and the same can be said of work stress. If one fails to relax his body and mind properly, physical and mental diseases tend to follow. Many people resort to massage or tui-na for bodily and mental relaxation, but both massage and tui-na are associated with the acupoints and joints of the body and therefore must be practiced by experienced professionals. While the market is now supplied with a variety of health equipment (e.g., massage chairs) designed to relax (e.g., massage) a user's body in his own home, the soaring prices make such equipment inaccessible to all.

In fact, not all practices of massage and tui-na require profound medical knowledge. For example, craniosacral therapy (CST), which was developed through years of research and clinical tests by the academic community, involves pressing a patient's head with fingers, with a gentle pressure less than 5 gram per $cm^2$, to enhance the balance of body movements and to promote the flow of bodily fluids. As the use of craniosacral therapy does not require sophisticated medical knowledge, it can be learned by the general public. Besides, the gentle press of craniosacral therapy, generally not heavier than the weight of a coin (5 grams), leaves no undesirable consequences even if applied slightly off the target positions.

The idea of craniosacral therapy began in the early $20^{th}$ century, when Dr. William Sutherland, a US orthopedist, found that the bones making up the human skull are slightly movable relative to one another rather than "totally immovable" as traditionally held in the medical world. Sutherland spent over 20 years studying and recording the reactions of force applied to different parts of each skull bone, and the result was the development of a skull examination and therapy system. Then, in 1970s, Dr. John E. Upledger, a neurosurgeon, who frequently participated in brain surgeries, found an interesting phenomenon that the human head and dura mater tend to move with the pulsing of the cerebrospinal fluid. He also found that the slight pulses can be felt by touching certain parts of the body, and that by applying a very gentle pressure (about 5 gram per $cm^2$) with the touching hands, the pressure of the cerebrospinal fluid can be adjusted for better health.

After decades of research, Upledger proposed the aforesaid craniosacral therapy, whose principles are briefly stated as follows. To begin with, the craniosacral system, which is a rhythmic system of the human body in addition to heartbeat and breathing, includes the meninges and the cerebrospinal fluid that protects the brain and the spinal cord. The extent of the craniosacral system starts from such upper parts of the body as the skull, the face, and the mouth and extends all the way downward to the sacrum or coccyx. As the craniosacral system influences the development and operation of the brain and the spinal cord, an unbalance or hindrance of the craniosacral system may lead to obstacles in the sensory, motor, or neural system. Craniosacral therapy is a therapy that assists the natural healing ability of the human body. A patient is generally requested to lie or sit on a therapy bed while the therapist puts his hands gently on the patient's body to "listen" to the rhythm inside. Craniosacral therapy is a gentle, manual, and holistic approach to physical examination and treatment and is beneficial to many body systems. Whether performed alone or in combination with other therapies, craniosacral therapy works equally well on the human body.

Referring to FIG. 1 and FIG. 2, the human skull is composed of several bones, including the frontal bone FB, the sphenoid bones SB, the parietal bones PB, the occipital bone OB, and the temporal bones TB, to mention only those directly related to craniosacral therapy. During craniosacral therapy, the therapist supports the patient's two parietal bones PB with hands so as to relax the mastoid process TB1 of each temporal bone TB. Then, the therapist presses the patient's occipital bone OB at positions adjacent to the external occipital protuberance EOP and the exit occipital crest EOC (the therapist should not press beyond the jugular processes OB1 of the occipital bone OB, i.e., where the occipitomastoid sutures OS are situated). At this moment, the parietal bones PB will have moved outward to a small degree such that the gap therebetween opens slightly. As a result, the pressure of the cerebrospinal fluid inside the skull is reduced to enhance circulation of the cerebrospinal fluid. Craniosacral therapy helps improve the internal environment of the human body and restore the central nervous system to its optimal working condition. The same therapy can also provide an increased sense of ease and comfort, strengthen the immune system, and even improve patients' interpersonal relationships.

However, craniosacral therapy nowadays is mostly practiced by professionals (e.g., doctors, physical therapists, occupational therapists, chiropractors, etc.) and is rarely known to the public. Given its low prevalence, craniosacral therapy is also extremely expensive. In consideration of this, the inventor of the present invention came up with the idea of applying the principles of craniosacral therapy to the design of pillows, with a view to enabling the general public to feel the effects of craniosacral therapy, thereby increasing the understanding and acceptance of the therapy while promoting Dr. Upledger's painstaking research results. The issue to be addressed by the present invention, therefore, is to design a pillow with a novel structure capable of helping one who rests his head on the pillow to relax his head.

BRIEF SUMMARY OF THE INVENTION

It is an objective of the present invention to provide a head relaxing pillow. The pillow is made of an elastic material and includes a supporting main body, two contact portions, and a pressing portion. The top of the supporting main body is designed to support the neck of a user who lies face up. The bottom of the supporting main body is concavely provided with a recess. The supporting main body is provided with two sunken portions which are adjacent to two corresponding ends of the supporting main body respectively and which correspond in position to the user's temporal bones respectively. Each contact portion has one end connected to one of the two corresponding ends of the supporting main body. The other end (hereinafter referred to as the second end) of each contact portion corresponds in configuration to the corresponding one of the user's parietal bones. The pressing portion extends from one side of the supporting main body and is located between the contact portions. When the user is lying, face up, such that his neck and head are resting on the supporting main body and the contact portions respectively, the user's temporal bones correspond in position to the sunken portions respectively. Meanwhile, the supporting main body is deformed (i.e., sags) toward the recess due to the weight of the user's neck, thereby bending the second ends of the contact portions upward toward the user's parietal bones to support the parietal bones respectively. At the same time, the free end of the pressing portion bends upward toward the external occipital protuberance and the exit occipital crest of the user's occipital bone to press against the occipital bone. Thus, the gaps in the user's skull are allowed to open slightly to lower the pressure of the cerebrospinal fluid in the skull and thereby enhance circulation of the cerebrospinal fluid.

It is another objective of the present invention to provide the foregoing head relaxing pillow, wherein the bottom of the supporting main body is further formed with a first inclined surface which is adjacent to the user's body and which corresponds in position to the recess. When the user's neck is resting on the supporting main body, the first inclined surface of the supporting main body lies firmly and compliantly against a flat surface (e.g., a bed) and serves as a fulcrum, allowing the moments of force generated by the bending of the contact portions and the pressing portion to act precisely on, and thereby provide sufficient support to, the user's parietal bones and the occipital bone respectively.

Yet another objective of the present invention is to provide the foregoing head relaxing pillow, wherein the top of the supporting main body is provided with a second inclined surface. When the pressing portion presses against the user's occipital bone due to the sagging of the supporting main body, the second inclined surface of the supporting main body lies compliantly against and thereby presses against the portion of the user's head that corresponds in position to the external occipital protuberance.

BRIEF DESCRIPTION OF THE SEVERAL VIEWS OF THE DRAWINGS

The above and other objectives, as well as the technical means and structural features, of the present invention will be best understood by referring to the following detailed description of some illustrative embodiments in conjunction with the accompanying drawings, in which.

DETAILED DESCRIPTION OF THE INVENTION

Figure 1:
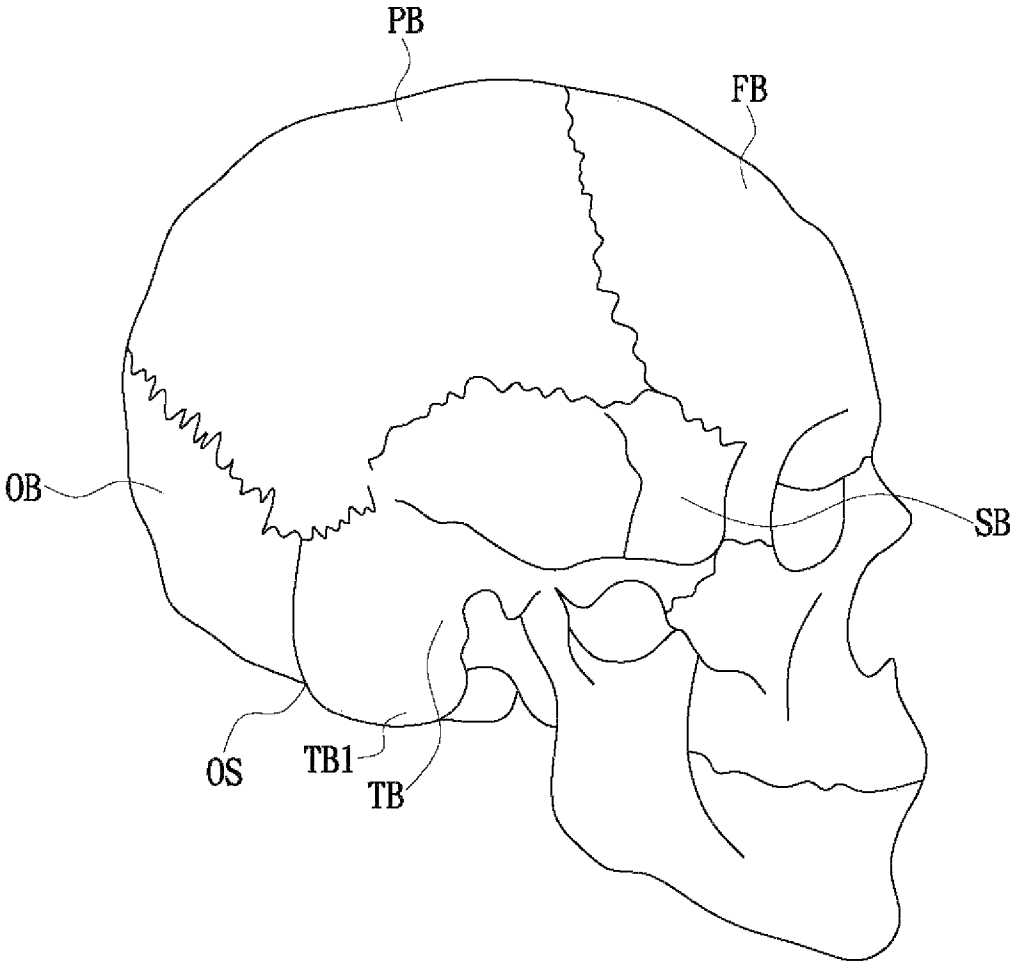
FIG. 1(Prior Art)
FIG. 1 is a schematic drawing of the human skull.
Figure 2:
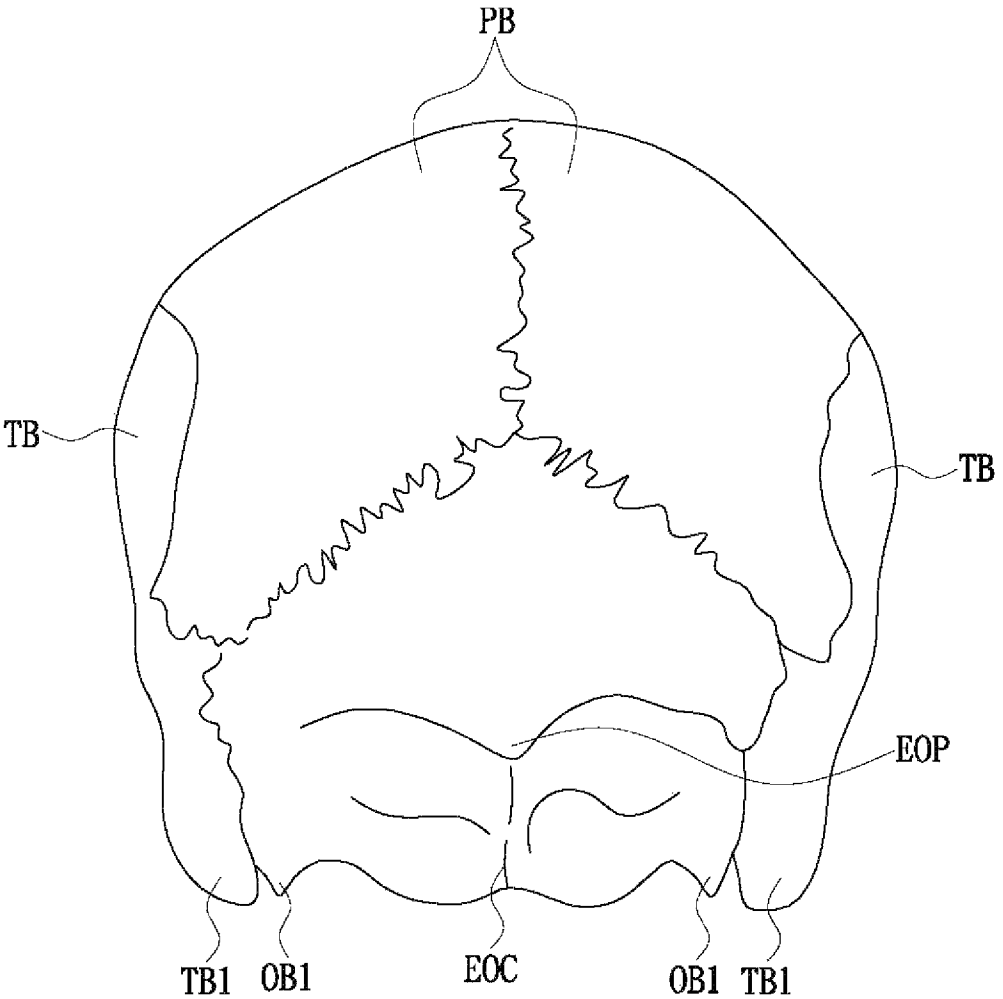
FIG. 2(Prior Art)
FIG. 2 is another schematic drawing of the human skull.
Figure 3:
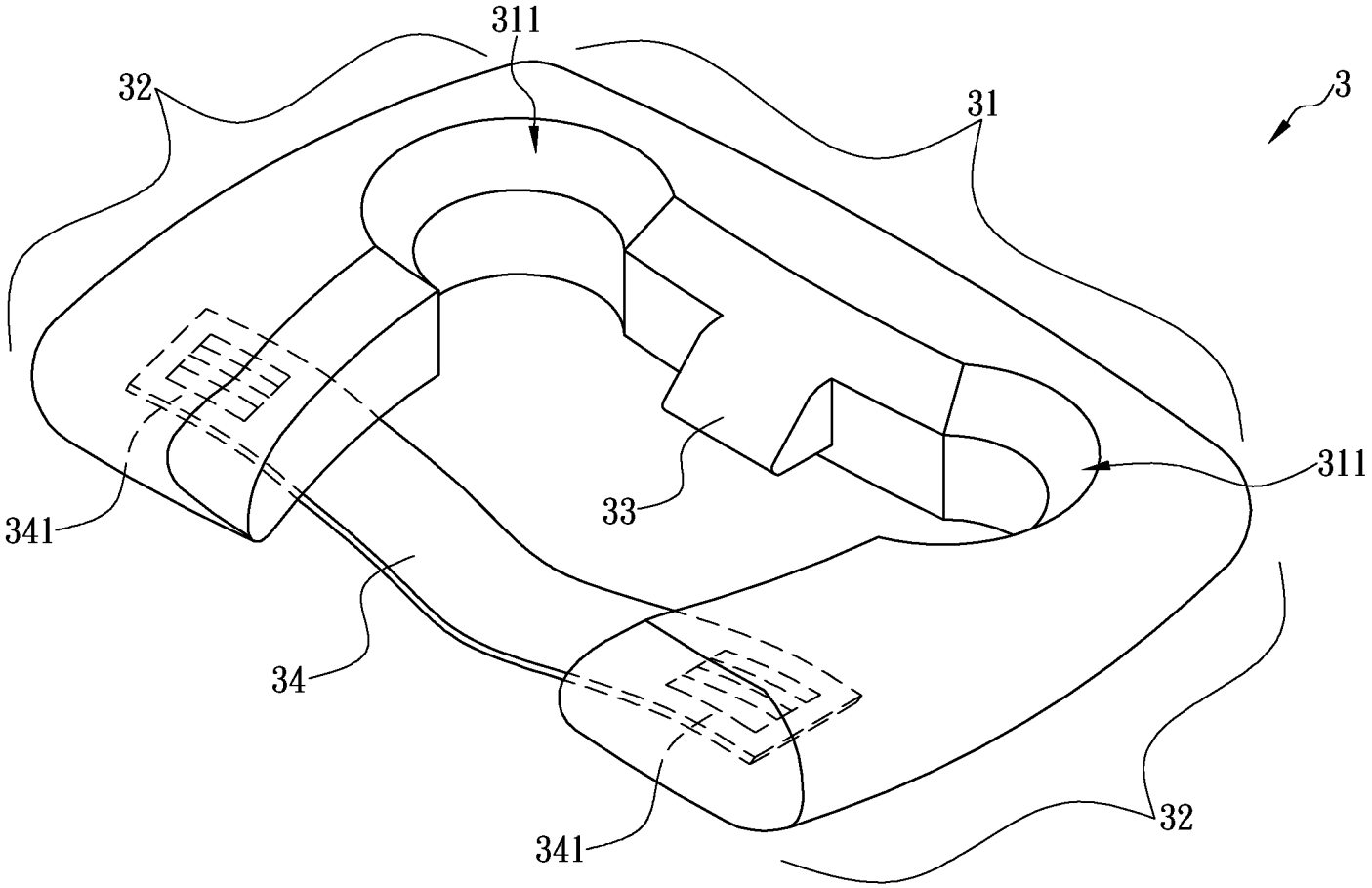
FIG. 3 is a perspective view of the pillow of the present invention.
Figure 4:
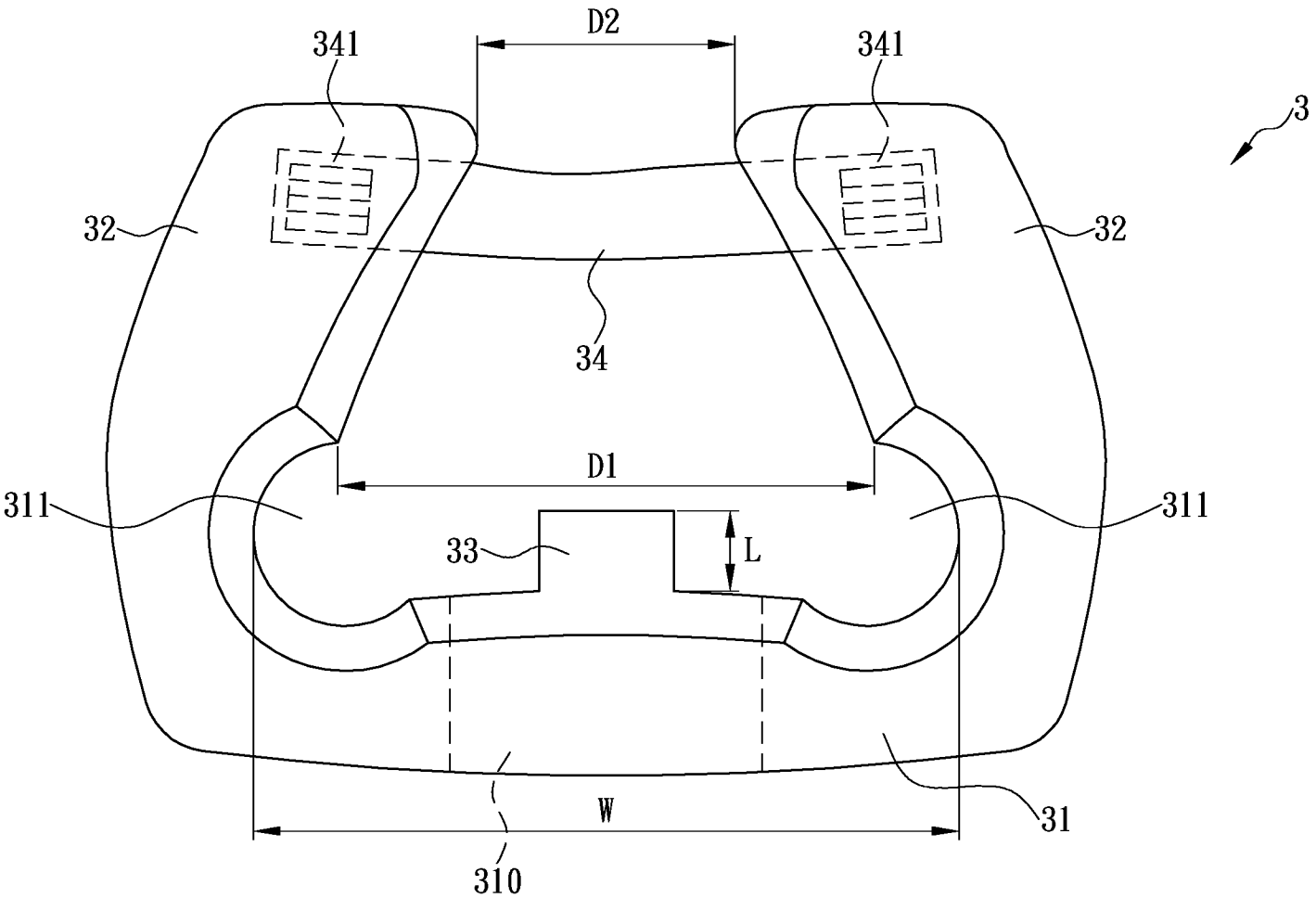
FIG. 4 is a top view of the pillow of the present invention.
Figure 5:
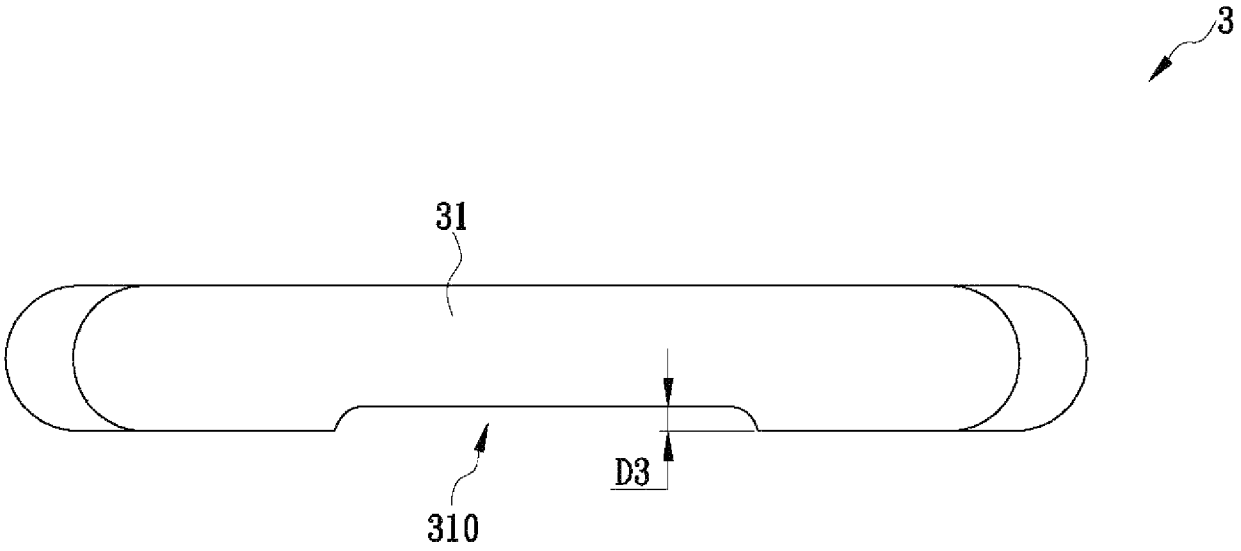
FIG. 5 is a rear view of the pillow of the present invention.

The present invention relates to a head relaxing pillow. Referring to FIG. 3 for the first preferred embodiment of the present invention, the head relaxing pillow 3, which is generally U-shaped and made of an elastic material, includes four parts, namely a supporting main body 31, two contact portions 32, and a pressing portion 33. The principles of the present invention lie in craniosacral therapy, and the intended effects include releasing the pressure within the user's head and promoting circulation of the cerebrospinal fluid. The present invention allows the user to experience craniosacral therapy, which traditionally must rely on the hands of a professional physical therapist.

Referring to FIG. 3 through FIG. 6, the top of the supporting main body 31 is configured for supporting the neck of a user who assumes a face-up recumbent position. The bottom of (the supporting main body 31 is concavely provided with a recess 310. In this embodiment, the recess 310 extends through the middle portion of the bottom of the supporting main body 31 and is generally rectangular, and yet the configuration of the recess 310 is not limited to that shown in FIG. 4 and FIG. 5). The supporting main body 31 is provided with a pair of sunken portions 311 which are respectively adjacent to two corresponding ends of the supporting main body 31 and which correspond in position to the user's temporal bones respectively. (The distance W between the outer edges of the sunken portions 311 ranges from 14 to 20 cm and can be adjusted as appropriate.) When the user's head is resting on the pillow 3, the temporal bones (which correspond in position to the ears respectively) should be received in the sunken portions 311 respectively.

Each contact portion 32 has one end (hereinafter referred to as the first end) connected to one of the two corresponding ends of the supporting main body 31, wherein the first ends of the contact portions 32 are spaced apart by a first predetermined distance D1. The other end (hereinafter referred to as the second end) of each contact portion 32 extends away from the supporting main body 31, and the second ends of the contact portions 32 are spaced apart by a second predetermined distance D2. The second predetermined distance D2 is less than the first predetermined distance D1 such that the contact portions 32 correspond in configuration to the user's two parietal bones respectively and can support the user's head.

Figure 6:
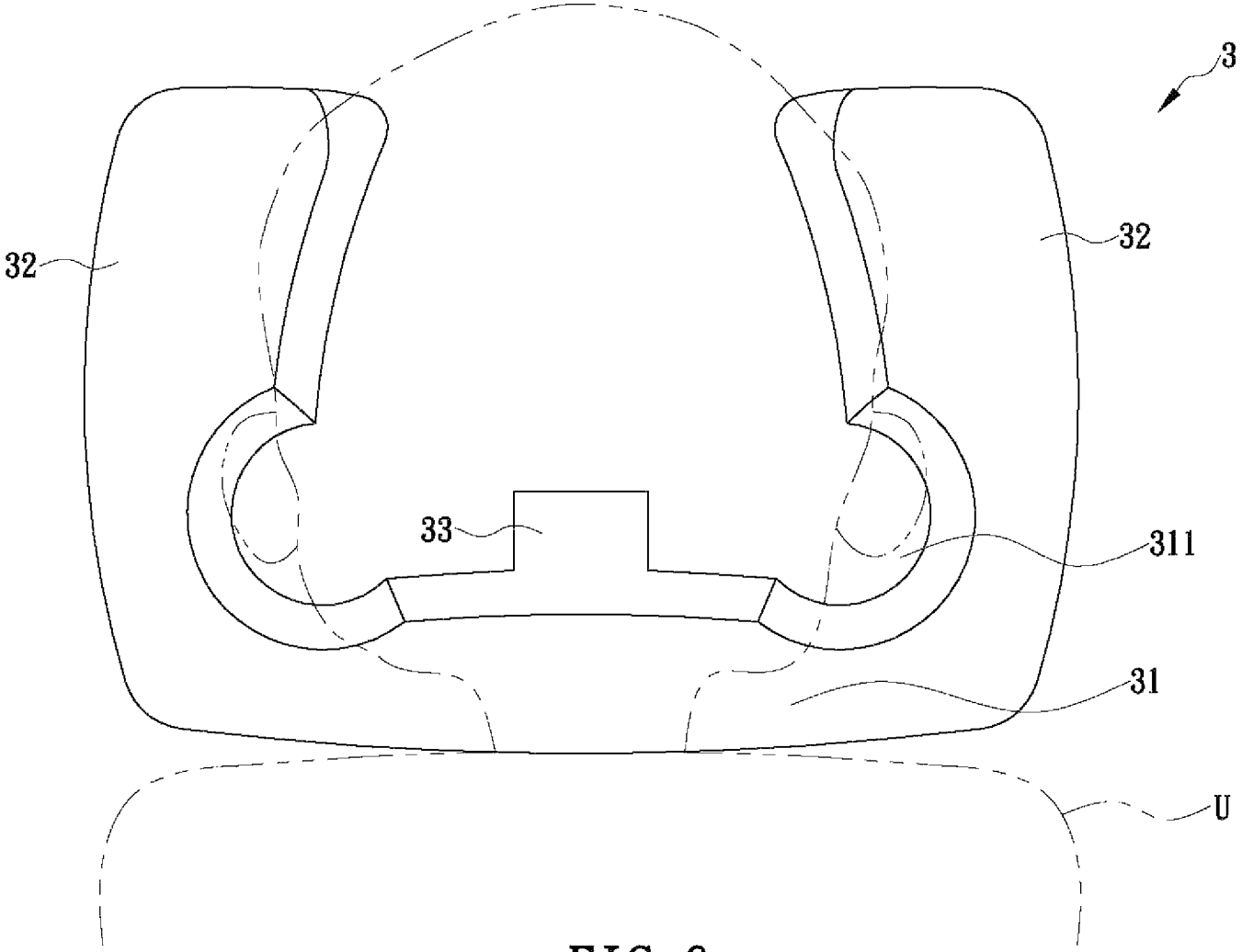
FIG. 6 is a schematic drawing simulating the pillow of the present invention in use.
Figure 7A:
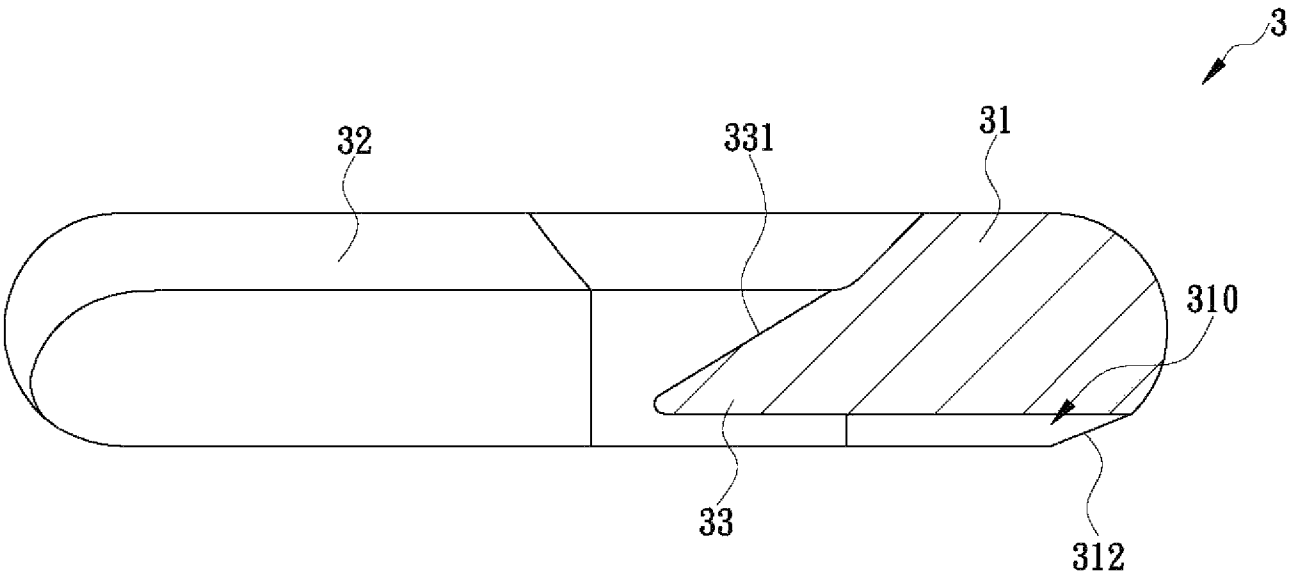
FIG. 7A is a sectional view of the pillow of the present invention.
Figure 7B:
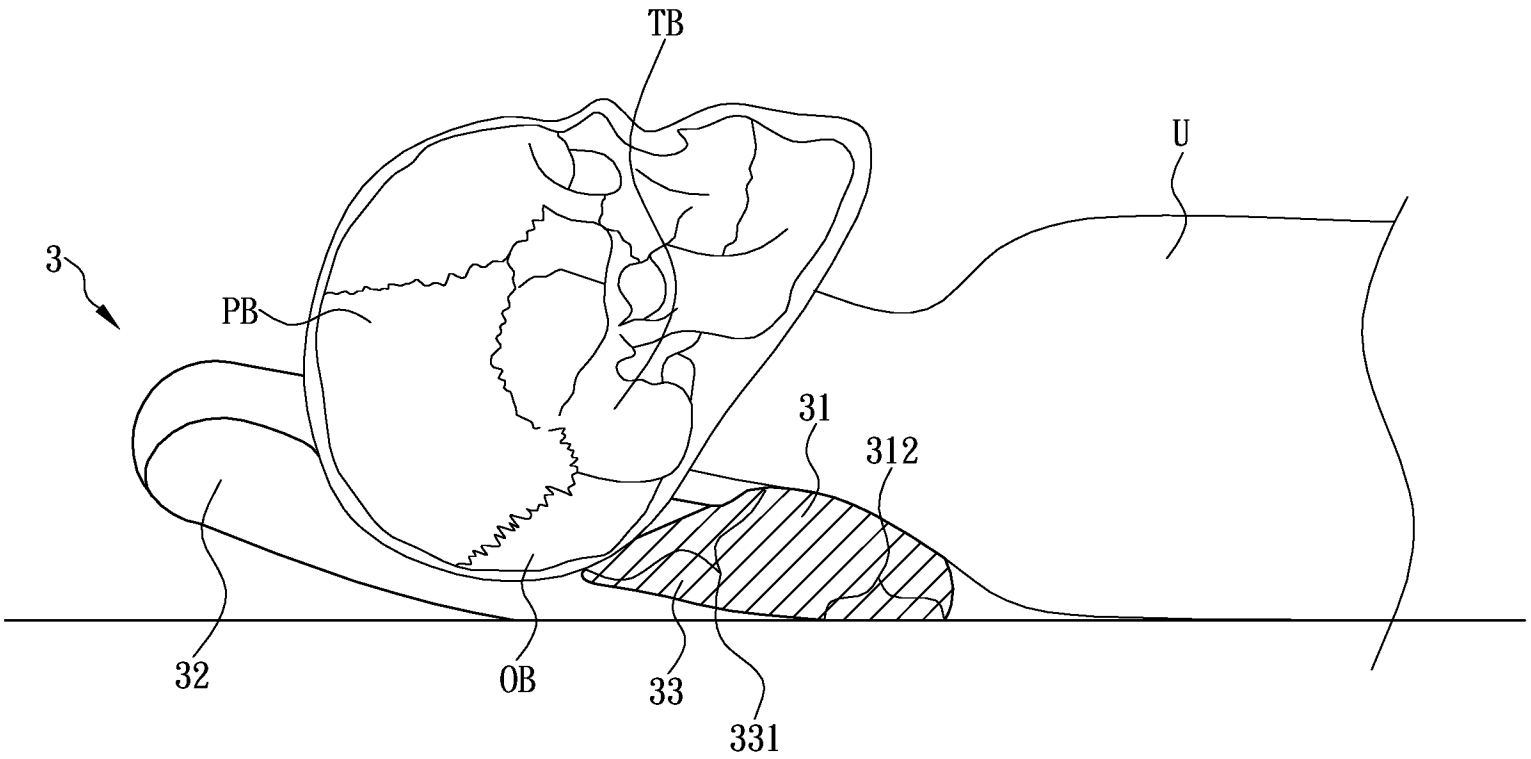
FIG. 7B is another schematic drawing simulating the pillow of the present invention in use.

Referring to FIG. 3 and FIG. 6, the pressing portion 33 extends from one side (hereinafter referred to as the first side) of the supporting main body 31 and is located between the contact portions 32. When the user U rests his head on the pillow 3, facing up, the user U's neck and head are respectively supported by the supporting main body 31 and the contact portions 32. In the meantime, the user U's temporal bones correspond in position to the sunken portions 311 respectively and are free from compression by the supporting main body 31. Referring to FIGS. 3, 4, 6, and 7A, the supporting main body 31 can sag toward the recess 310 due to the weight of the user U's neck, causing the two corresponding ends of the supporting main body 31 to bend upward. Consequently, the second ends of the contact portions 32 bend upward toward the user U's parietal bones to support the two parietal bones respectively. The pillow 3 ends up in the shape shown in FIG. 7B.

As the portion of the supporting main body 31 that corresponds in position to the recess 310 can lie against a flat surface below the pillow 3 (e.g., a bed) to serve as a fulcrum, the free end of the pressing portion 33 (i.e., the end away from the supporting main body 31) in this state will bend upward toward the user U's occipital bone, pressing against the portion of the occipital bone that is adjacent to the external occipital protuberance. Thus, referring to FIG. 3 and FIG. 7B, when the user U assumes a face-up recumbent position, with the neck and head resting on the pillow 3, the temporal bones TB are respectively and relaxedly located in the sunken portions 311, and the parietal bones PB are respectively supported on the contact portions 32. In the meantime, with the bending of the pillow 3, the pressing portion 33 presses against and supports the portion of the occipital bone OB that is adjacent to the external occipital protuberance and the exit occipital crest, and the supporting force of the pressing portion 33 generates an outward moment of force (i.e., toward the upper left corner of FIG. 7B) acting on the user U's parietal bones PB. The portions of the contact portions 32 that respectively support the user's parietal bones PB also generate an outward moment component. These moments of force cause the gaps in the user U's skull (i.e., the gap between the two parietal bones and the gap between the parietal bones and the occipital bone) to open slightly, thereby reducing and regulating the internal stress within the user U's head (i.e., the pressure of the cerebrospinal fluid in the skull) and promoting circulation of the cerebrospinal fluid.

Besides, in the above embodiment, when the pressing portion 33 is pressing against the occipital bone OB of the user U's head, the pressing force produced by the pressing portion 33 and applied to the occipital bone OB is able to slightly disengage the occipital bone OB from the user U's atlas (i.e. the first cervical vertebra), so as to decompress the occipital condylar region below the occipital bone OB and then release the cranial base and tissues around the jugular foramena of the user U accordingly. Since the glossopharyngeal nerves, vagus nerves and accessory cranial nerves (i.e. the ninth, tenth and eleventh pairs of cranial nerves) of human body are all passing through the jugular foramena, release of any compromise of these tissues around jugular foramena often has a beneficial effect on the functions of these nerves respectively.

In this embodiment, referring to FIGS. 1 and 3~7B, the depth D3 of the recess 310 is about 1~5 cm, and the bottom of the supporting main body 31 is further formed with a first inclined surface 312 which is adjacent to the user U's body and which corresponds in position to the recess 310. When the user U's neck is resting on the supporting main body 31, the supporting main body 31 lies firmly and compliantly against the flat surface thanks to the first inclined surface 312 (it is also feasible to form the recess 310 only on the other side of the supporting main body 31, i.e., the side adjacent to the user, so as to increase the degree of tilting), allowing the moments of force generated respectively by the bent contact portions 32 and the bent pressing portion 33 to act respectively and precisely on the user U's parietal bones PB and external occipital protuberance, thus providing sufficient support for the parietal bones PB and the occipital bone OB respectively. In addition, the top of the pressing portion 33 is provided with a second inclined surface 331, and the length L of the pressing portion 33 that extends from the first side of the supporting main body 31 ranges from 1 to 4 cm. When the pressing portion 33 presses against the user's occipital bone OB due to the sagging of the supporting main body 31, the second inclined surface 331 of the pressing portion 33 functions as a therapist's fingers lying compliantly against and thereby pressing the portions of the user's head that are adjacent to the external occipital protuberance EOP and the exit occipital crest EOC (the pressed positions should not go beyond the jugular processes OB1 of the occipital bone OB, i.e., where the occipitomastoid sutures OS lie).

The pillow of the present invention can be customized according to the user's bodily shape (e.g., the stature, head shape, torso). In particular, adjustment can be made to the second predetermined distance D2 between the second ends of the contact portions 32, the extension length L of the pressing portion 33, and the depth D3 of the recess 310. In this embodiment, the pillow 3 further includes a fastening strap 34 whose two ends 341 are respectively and movably connected to the second ends of the contact portions 32 (e.g., via Velcro). With the fastening strap 34, the user can adjust the second predetermined distance D2 between the contact portions 32. For example, the second predetermined distance D2 can be reduced for a user with a relatively pointed head in order for the contact portions 32 to support the user's parietal bones PB respectively. Conversely, the second predetermined distance D2 can be increased for a user with a relatively flat head in order to support the parietal bones PB without pressing too tight.

It should be pointed out that, while the sunken portions 311 in the foregoing embodiment are circular cavities in which the temporal bones TB of a user resting his head on the pillow 3 can respectively stay without the skin outside the temporal bones TB being in contact with the surface of the supporting main body 31, the configuration of the sunken portions 311 is not limited to the above. Moreover, the pillow 3 may be enclosed in a layer of cloth for esthetic reasons, and in that case, the skin outside the temporal bones TB of a user resting his head on the pillow 3 may be in contact with the cloth. However, as long as the portions of the pillow 3 that correspond in position respectively to the temporal bones TB are provided with the sunken portions 311, the user's temporal bones TB can still stay in a relaxed state. That is to say, the layer of cloth will not interfere with the intended functions of the pillow 3.

While the invention herein disclosed has been described by means of specific embodiments, numerous modifications and variations could be made thereto by those skilled in the art without departing from the scope of the invention set forth in the claims.

What is claimed is:

1. A head relaxing pillow, made of an elastic material, the head relaxing pillow comprising:

a supporting main body having a top surface adapted to support a neck of a user lying face up, the supporting main body having a bottom surface concavely provided with a recess extending continuously between a pair of opposing contact portions, the supporting main body being provided with two arcuate through openings defining a pair of arcuate sunken portions which are respectively adjacent to two corresponding ends of the supporting main body, and are in open communication with each other and adapted to be configured to correspond in position to the user's temporal bones respectively, wherein the bottom surface of the supporting main body is formed to configure with a first inclined surface adjacent to the user's body, the first inclined surface being adjacent to the recess so that, when the user's neck is resting on the supporting main body, the supporting main body lies firmly and compliantly against a flat surface below the head relaxing pillow due to the first inclined surface and the recess deforms and the bottom surface lies against the flat surface;

said contact portions having respective top surfaces and each having a first end directly connected to the respective corresponding end of the supporting main body adjacent to the respective arcuate sunken portion, the first ends of the contact portions being formed to be spaced apart by a first predetermined distance, each said contact portion having a second end extending away from the supporting main body, the second ends of the contact portions being formed to be spaced apart by a second predetermined distance, wherein the second predetermined distance is less than the first predetermined distance so that the contact portions are adapted to be configured to correspond to the user's two parietal bones respectively, said top surfaces of said contact portions and main body being directly connected to each other and substantially co-planar each to the other; and a pressing portion extending from a side of the supporting main body toward the second ends of the two contact portions and located between the arcuate sunken portions and having a centrally positioned apex portion directed toward the second ends of the two contact portions so that, when the user's neck and head are respectively resting on the supporting main body and the contact portions, not only do the user's temporal bones correspond in position to the arcuate sunken portions respectively, but also the supporting main body corresponding to the recess deforms downward due to the weight of the user's neck, causing the two corresponding ends of the supporting main body to bend upward and the second ends of the contact portions to deform and bend upward toward and support the user's parietal bones, and consequently causing a free end of the pressing portion to deform and bend upward toward and press against the user's occipital bone, said pair of contact portions, said supporting main body and said pressing portion forming a generally omega-shaped contour adapted to receive the user's head with the generally omega-shaped contour;

wherein the pressing portion has a top provided with a second inclined surface extending to the centrally positioned apex portion so that, when the pressing portion presses against the user's occipital bone due to the bending of the supporting main body, the second inclined surface of the pressing portion lies compliantly, and presses, against the user's head at a position adjacent to the external occipital protuberance and the external occipital crest, and the arcuate sunken portions are configured for contacting the user's temporal bones and avoiding contact with mastoid parts of the temporal bones.

2. The head relaxing pillow of claim 1, further comprising a fastening strap, wherein the fastening strap has two ends respectively and movably connected to the second ends of the contact portions.

3. The head relaxing pillow of claim 2, wherein the pressing portion has a length of 1-4 cm extending from the side of the supporting main body.

4. The head relaxing pillow of claim 3, wherein the arcuate sunken portions have outer edges which are 14-20 cm apart.

5. The head relaxing pillow of claim 4, wherein the recess is 1-5 cm deep.

* * * * *